US007594351B1

(12) United States Patent
Walker

(10) Patent No.: US 7,594,351 B1
(45) Date of Patent: Sep. 29, 2009

(54) DEVICE FOR SAFELY RAISING AND LOWERING A RIFLE BETWEEN THE GROUND AND AN ELEVATED STAND

(76) Inventor: Samuel E. Walker, 2708 Green Rd., Baldwin, MD (US) 21013

( * ) Notice: Subject to any disclaimer, the term of this patent is extended or adjusted under 35 U.S.C. 154(b) by 27 days.

(21) Appl. No.: 11/975,529

(22) Filed: Oct. 19, 2007

(51) Int. Cl.
*F41A 23/18* (2006.01)

(52) U.S. Cl. ..... 42/90; 42/94; 294/82.11

(58) Field of Classification Search ..... 42/90, 42/94; 211/64, 209; 294/1.1, 82.11
See application file for complete search history.

(56) References Cited

U.S. PATENT DOCUMENTS

| | | | | |
|---|---|---|---|---|
| 3,910,382 | A | 10/1975 | Justice | 187/17 |
| 3,938,273 | A | 2/1976 | Tellié | 42/94 |
| 4,397,112 | A | 8/1983 | York | 42/94 |
| 4,560,134 | A | 12/1985 | Klein | 248/511 |
| 4,625,620 | A | 12/1986 | Harris | 89/37.04 |
| 5,626,379 | A * | 5/1997 | Scott | 294/143 |
| 5,655,803 | A * | 8/1997 | Tacoronte | 294/1.1 |
| D446,839 | S | 8/2001 | Cantrell | D22/108 |
| 6,819,404 | B2 | 11/2004 | Tanaka | 355/72 |
| 6,988,755 | B2 * | 1/2006 | Lukas | 294/1.1 |
| 2008/0018122 | A1 * | 1/2008 | Zierler et al. | 294/1.1 |

* cited by examiner

*Primary Examiner*—Michael Carone
*Assistant Examiner*—Reginald Tillman, Jr.

(57) ABSTRACT

A device to be removably attached to a rifle or weapon to safely hoist and lower the weapon to and from an elevated stand. The device has a pair of legs which, together with the butt of the weapon, form a tripod to support the weapon while it is on the ground. A method for using the device.

7 Claims, 10 Drawing Sheets

DEVICE FOR SAFELY RAISING AND LOWERING A RIFLE BETWEEN THE GROUND AND AN ELEVATED STAND

BACKGROUND OF THE INVENTION

The present invention pertains generally to the field of hunting and care of weapons. In more particular the present invention pertains to a device to safely raise or lower a rifle to an elevated hunting stand and a method for using the device.

DESCRIPTION OF RELATED ART

Hunters very frequently climb to an elevated stand such as one set up in a tree where the hunter has an improved view of the terrain and is screened from being seen by the animal which is the target of the hunt. However, there is concern about the safety of the hunter climbing while holding a rifle and of the rifle being damaged, especially when it is lowered to the ground as the hunter descends.

The applicant is aware of the following U.S. patents which have been directed to this subject.

| U.S. Pat. No. | Inventor(s) |
|---|---|
| D 446,839 | Cantrell |
| 3,910,382 | Justice |
| 5,655,803 | Tacoronte |
| 6,819,404 | Pasquale |
| 6,988,755 | Lukas |

While recognizing the need for a device and method to solve this longstanding problem, the solutions offered in the respective patents are inadequate and have not been accepted by the hunting community. A need continues to exist, especially with respect to protecting the muzzle, bore and sights on the rifle from dirt and debris.

The applicant is also aware of U.S. patents for support of a rifle such as U.S. Pat. Nos. 3,938,273 to Tallié, 4,397,112 to York, 4,560,134 to Klein and 4,625,620 to Harris. These patents disclose various means to support a rifle but do not address the raising or lowering of the weapon to an elevated stand.

SUMMARY OF THE INVENTION

It is an object of the present invention to provide a device which can be easily attached to a rifle of any type so that the rifle may be safely hoisted and lowered between the ground and an elevated stand while protecting the muzzle, bore, sights and scope from dirt and debris and also providing a method of using the device.

It is still a further object of the present invention to provide a device and a method of raising and lowering a rifle wherein the rifle is supported on the ground by two legs attached to the muzzle and the butt of the rifle forming a third leg.

It is another object of the invention to provide a small lightweight device which may be attached to the muzzle of a rifle to facilitate raising and lowering the rifle between the ground and an elevated stand.

In accordance with the teachings of the present invention, there is disclosed a device for safely hoisting a rifle up to a tree stand during hunting season and subsequently lowering the rifle before coming down from the tree stand. The device has means for detachably mounting the device to the rifle. A rope attachment means is provided on the device, such that a rope may be attached to the device. A pair of extendable legs are pivotably mounted on the device, one on each side thereof, such that the legs may be extended away from the device. The extended legs, together with the butt portion of the rifle's stock, form a three-point tripod, whereby the rifle may rest on the ground. The rifle may be safely raised and alternately lowered when going up and down the tree stand, respectively, and the muzzle, bore, sights and/or scope on the rifle are kept clear of dirt and/or debris.

In further accordance with the teachings of the present invention, there is disclosed the method of raising and lowering a weapon when climbing from a lower elevation to a higher elevation. A device is provided with means for removably attaching the device to the weapon. The removable attaching means includes a pair of legs pivotably mounted thereon, one on each side thereof. The pivotable legs are manually extended away from the device, such that the legs and a butt portion of the weapon form a tripod for supporting the weapon on the lower elevation, thereby keeping the muzzle, bore, sights and/or scope substantially free of dirt and/or debris. A rope is attached to the device. The hunter climbs to the higher elevation and uses the rope to pull up the device and the weapon from the ground. The device is detached from the weapon. The process is repeated substantially in reverse to lower the weapon to the lower elevation prior to climbing down from the higher elevation.

In addition, in accordance with the teachings of the present application, there is disclosed a method of safely raising and lowering a rifle when climbing up and down from a tree stand during hunting season. A device is provided with means for removably attaching the device to the barrel of the rifle, including a pair of legs pivotably mounted on the device, one on each side thereof. The pivotable legs are manually extended away from the device, such that the legs of the device and the stock of the rifle form a tripod for supporting the rifle on the ground, thereby keeping the muzzle, bore, sights and scope of the rifle substantially free of dirt and debris. A rope is attached to a loop means on the device. The user climbs up to the tree stand using the rope to pull up the device and the rifle from the ground. The device is detached from the rifle. The process is repeated substantially in reverse to lower the rifle to the ground prior to climbing down from the tree stand.

These and other objects of the present invention will become apparent from a reading of the following specification taken in conjunction with the enclosed drawings.

DETAILED DESCRIPTION OF THE INVENTION

Figure 1:
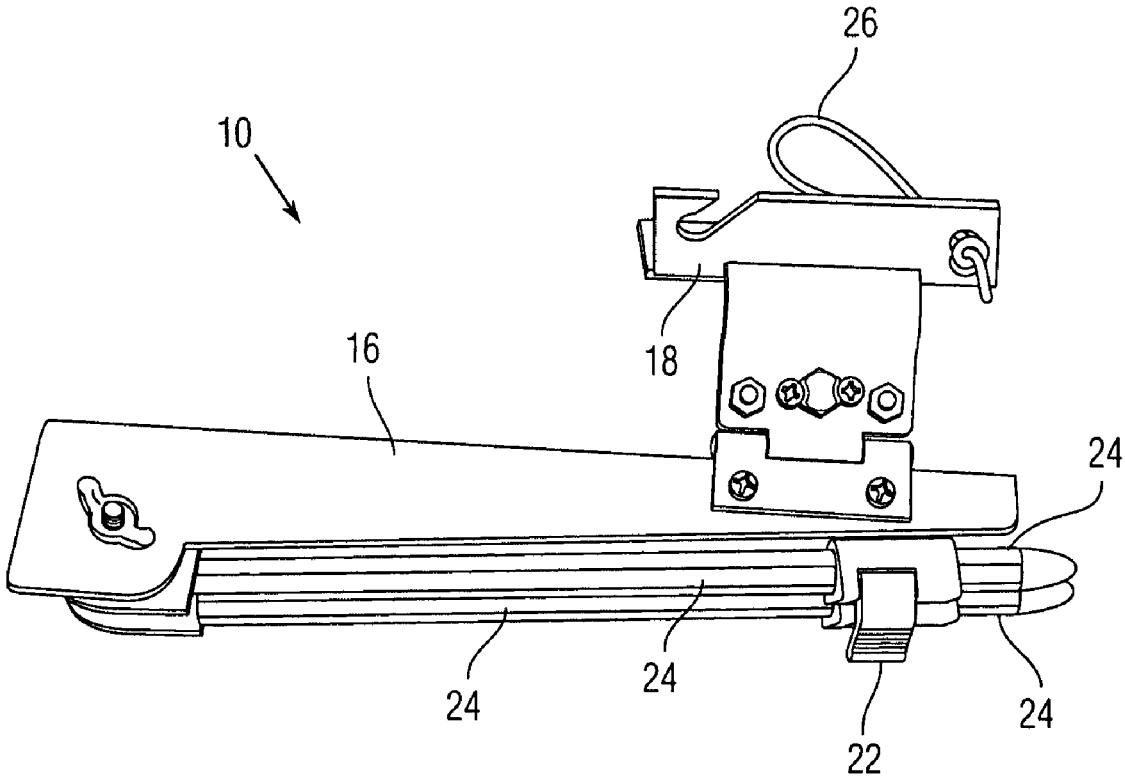
FIG. 1 is a perspective view of the device.
Figure 2:
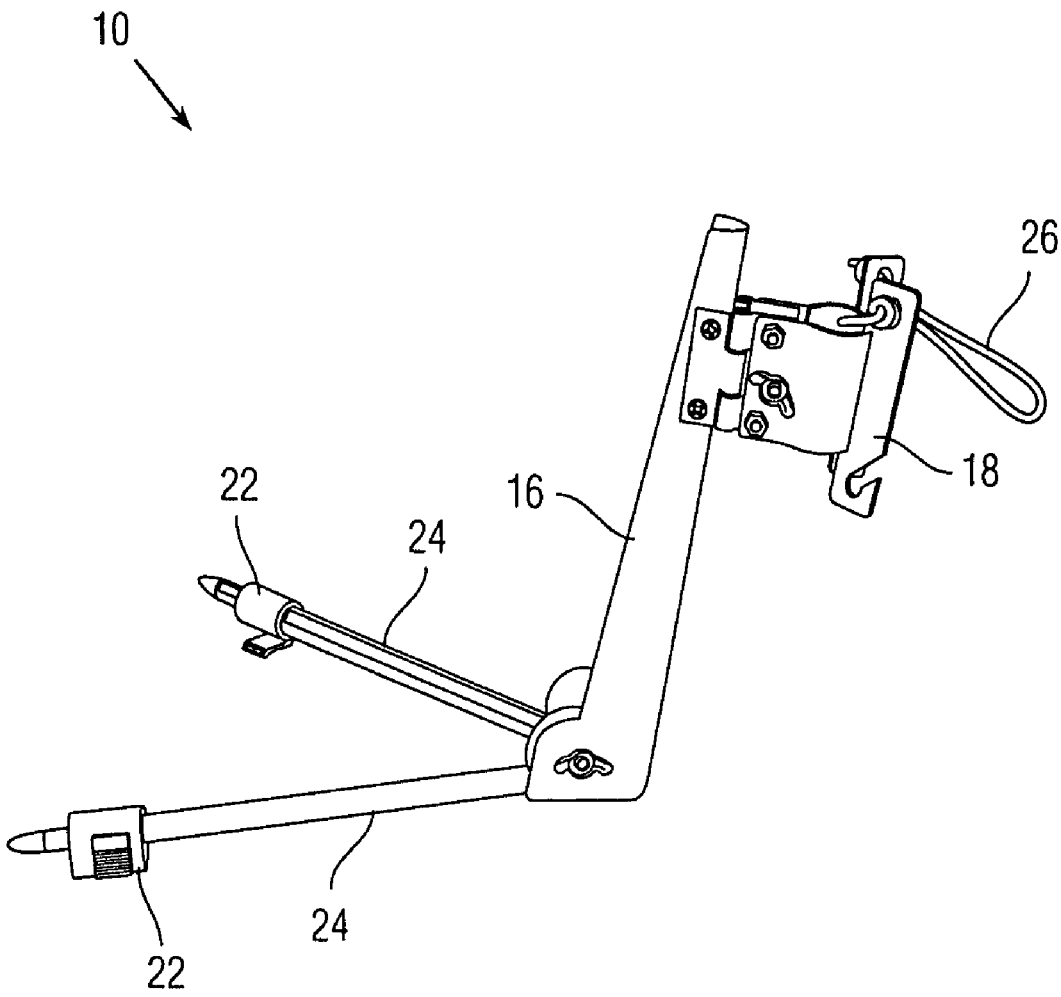
FIG. 2 is a perspective view of the device with legs angled.
Figure 3:
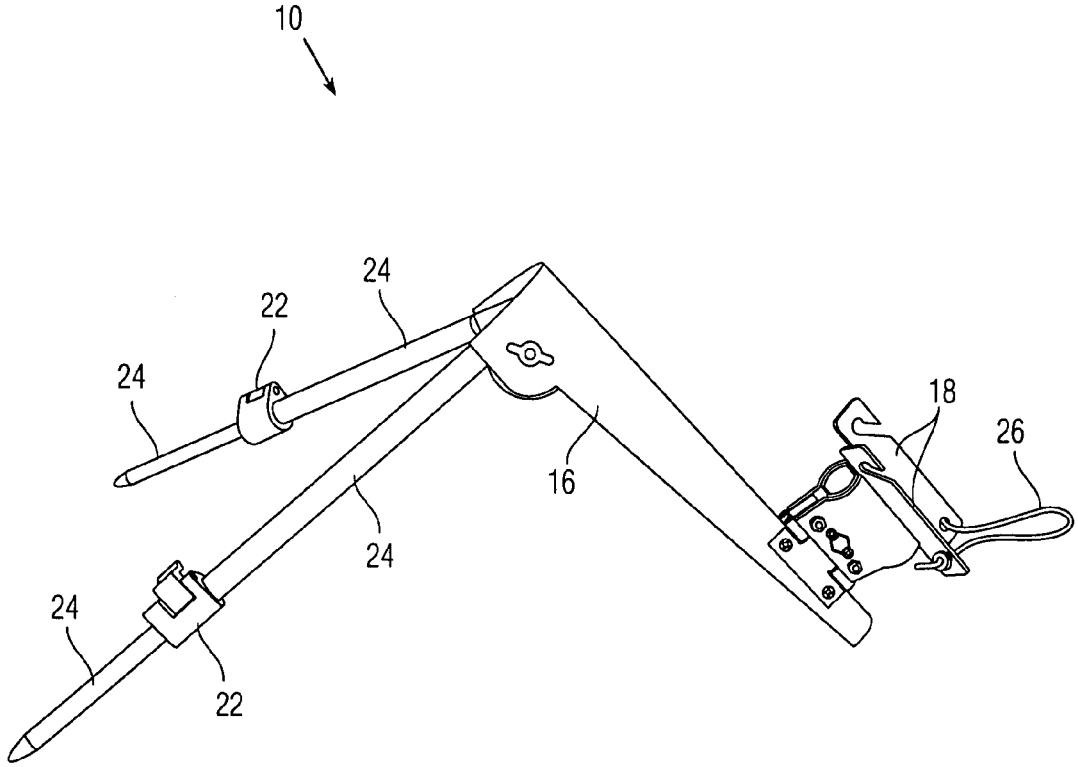
FIG. 3 is a perspective view of the device with legs extended.
Figure 4:
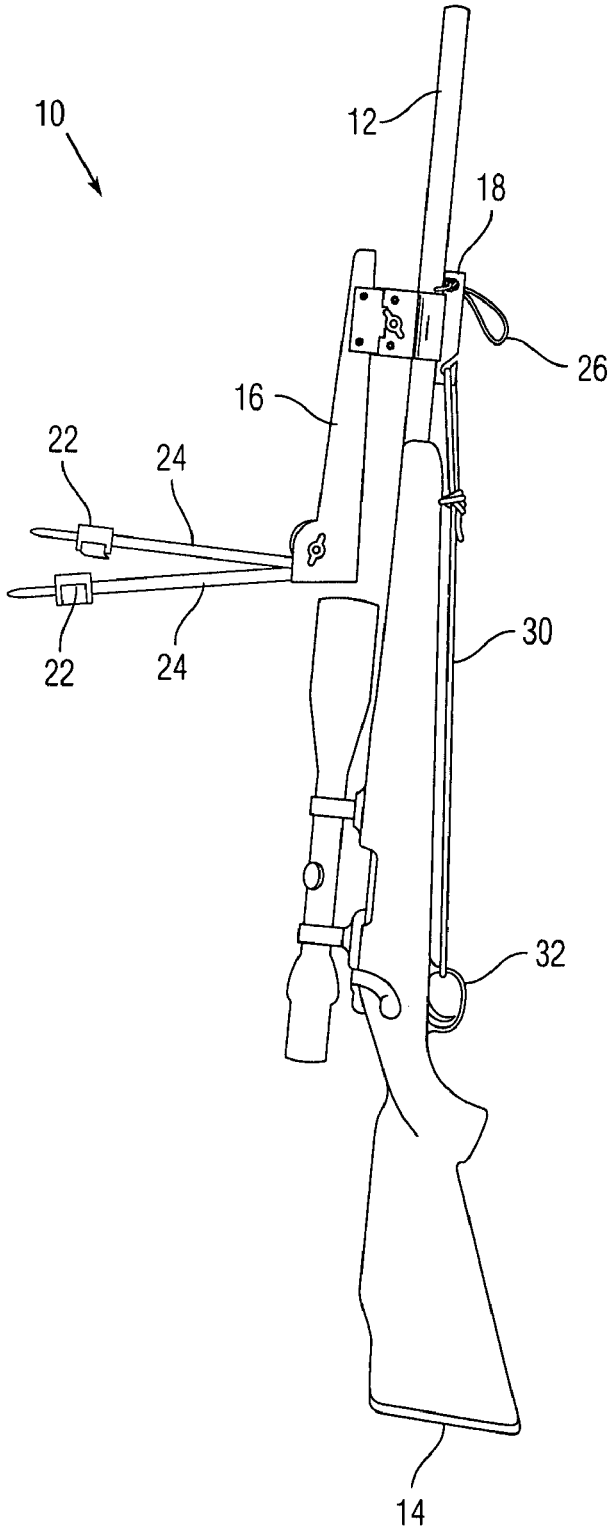
FIG. 4 is a side view of the device mounted on the rifle.
Figure 5:
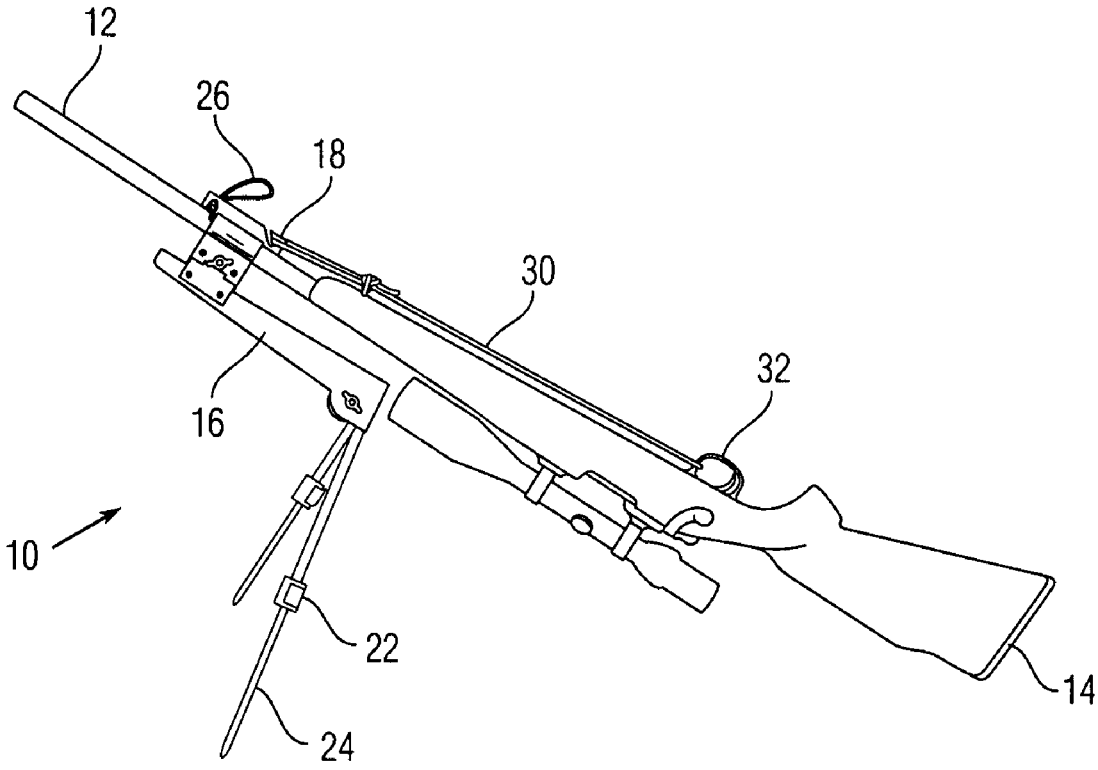
FIG. 5 is a perspective view of the rifle with the device resting on the ground.
Figure 6:
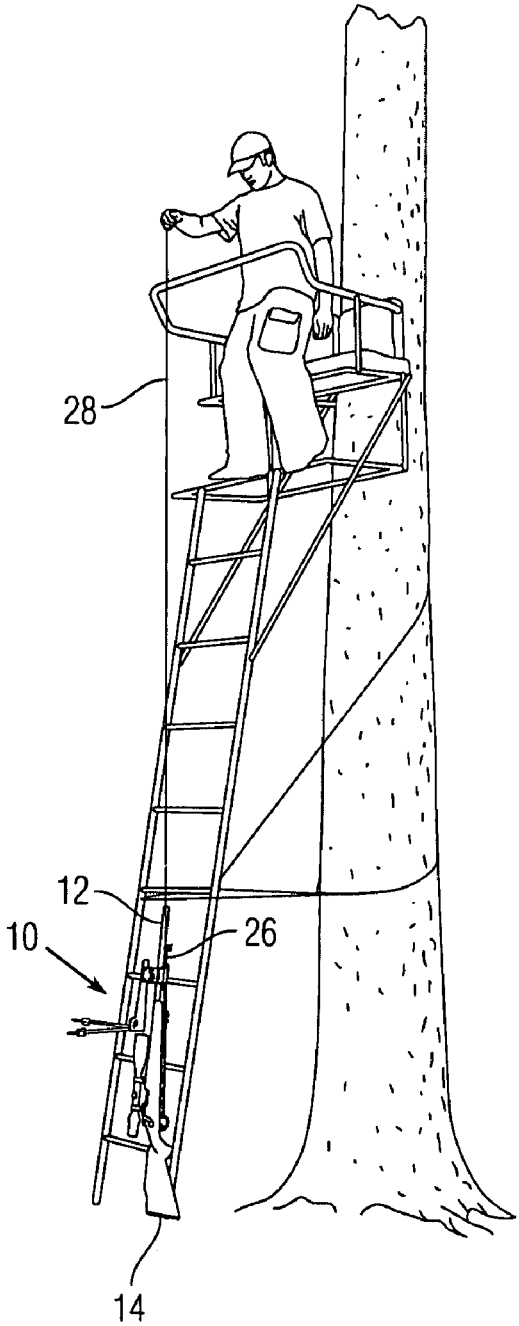
FIG. 6 is a perspective view of the hunter hoisting the rifle with the device.
Figure 7:
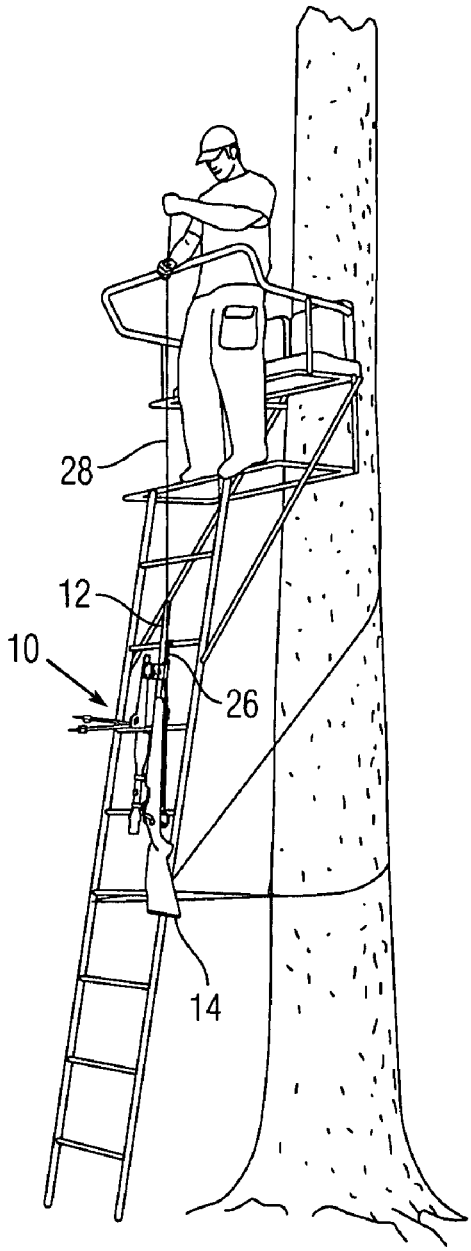
FIG. 7 is a perspective view of the hunter hoisting the rifle with the device midway to the tree stand.
Figure 8:
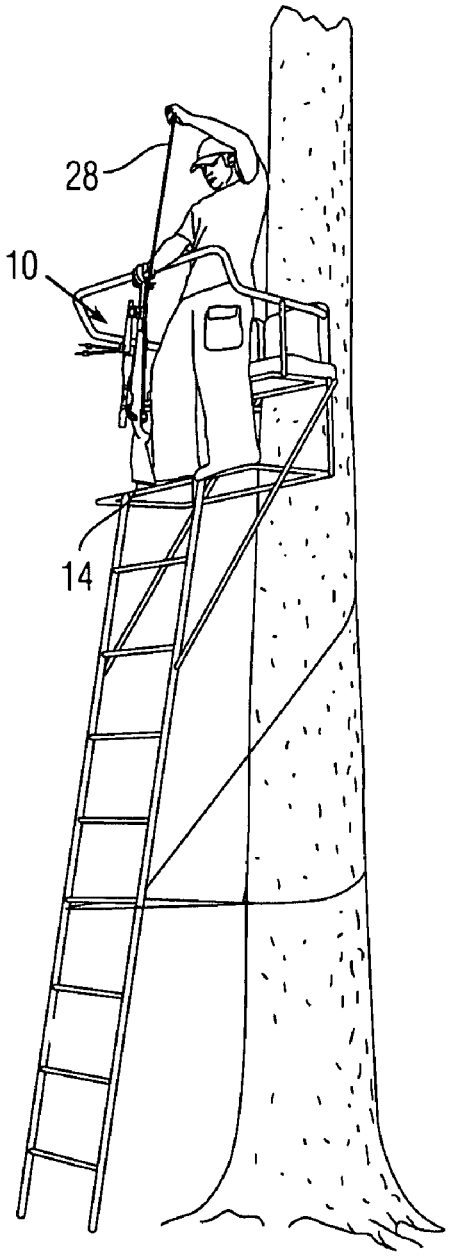
FIG. 8 is a perspective view of the hunter hoisting the rifle with the device in the tree stand.
Figure 9:
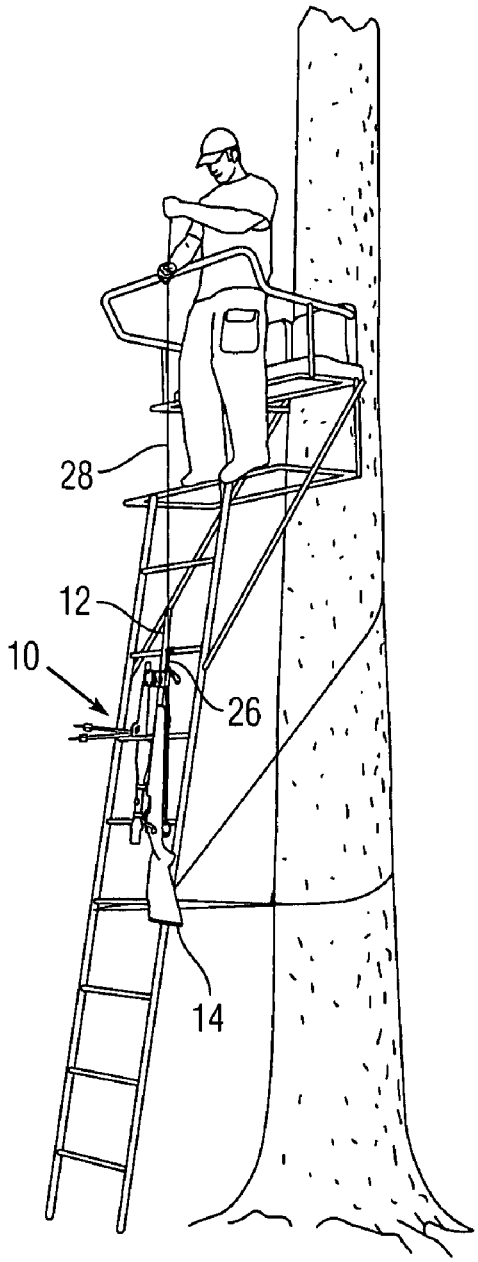
FIG. 9 is a perspective view of the hunter lowering the rifle with the device partially down.
Figure 10:
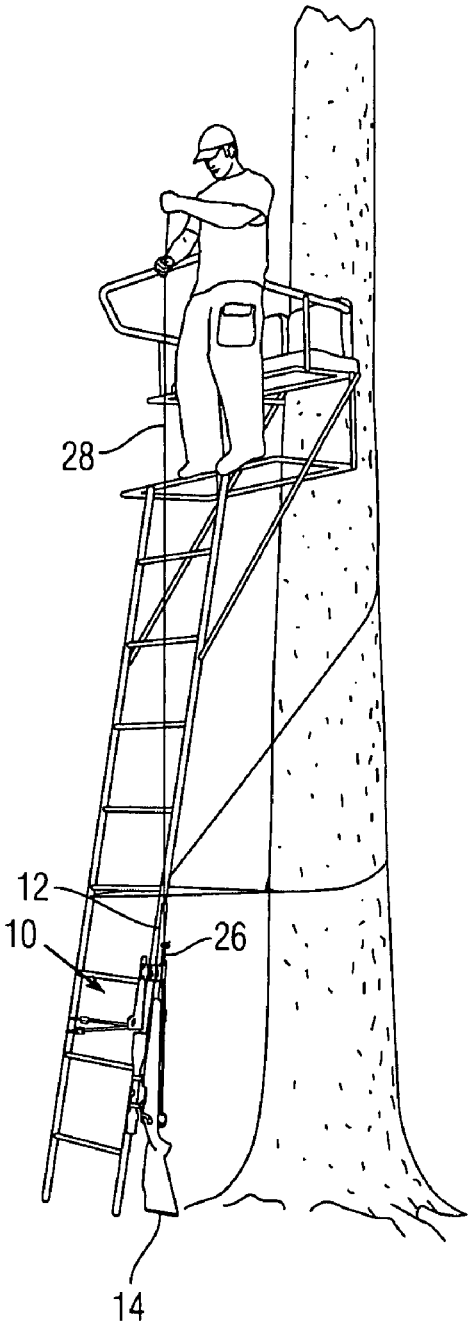
FIG. 10 is a perspective view of the hunter lowering the rifle with the device butt first on the ground.
Figure 11:
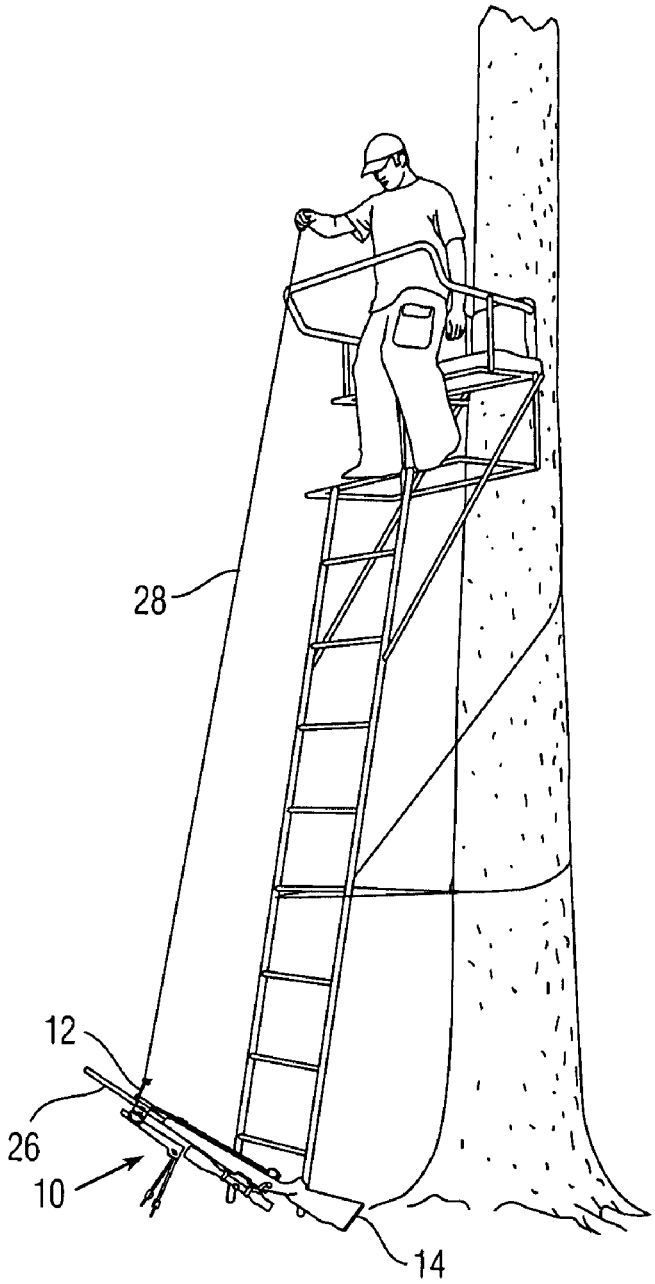
FIG. 11 is a perspective view of the hunter lowering the rifle with the device forming a tripod support.
Figure 12:
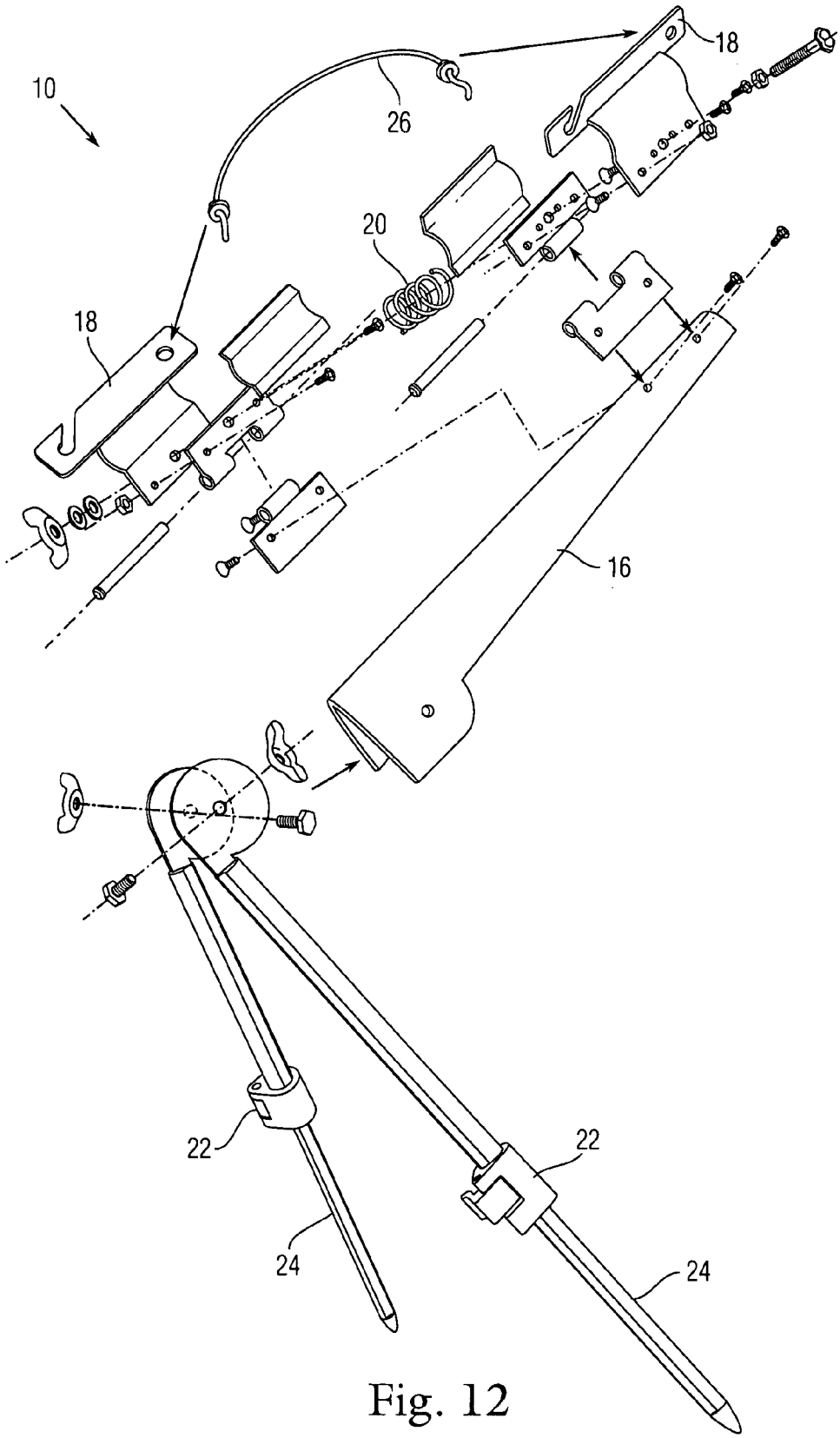
FIG. 12 is an exploded view of the device.
Figure 14:
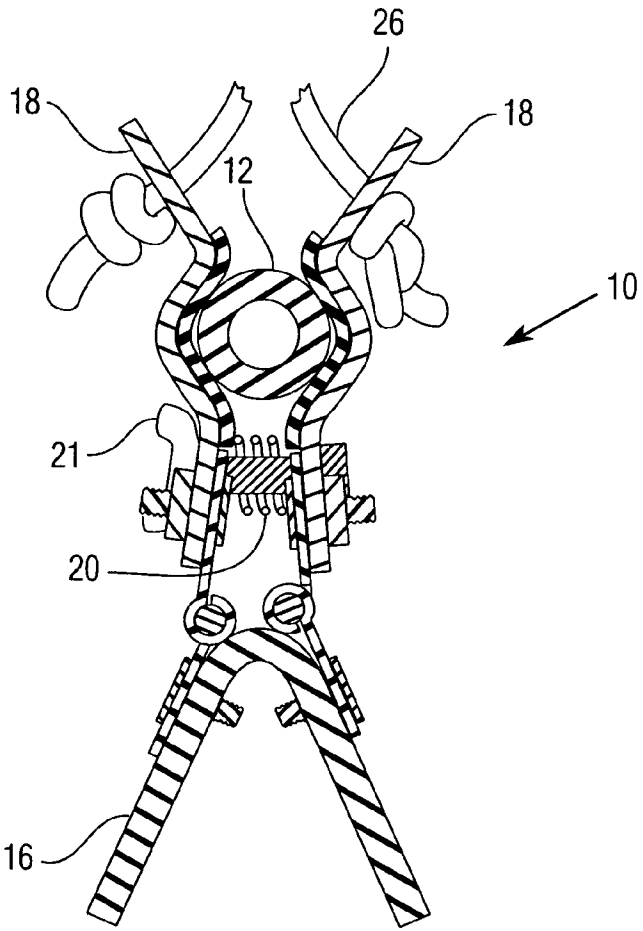
FIG. 14 is a cross section of plates holding small diameter barrel of the rifle.
Figure 13:
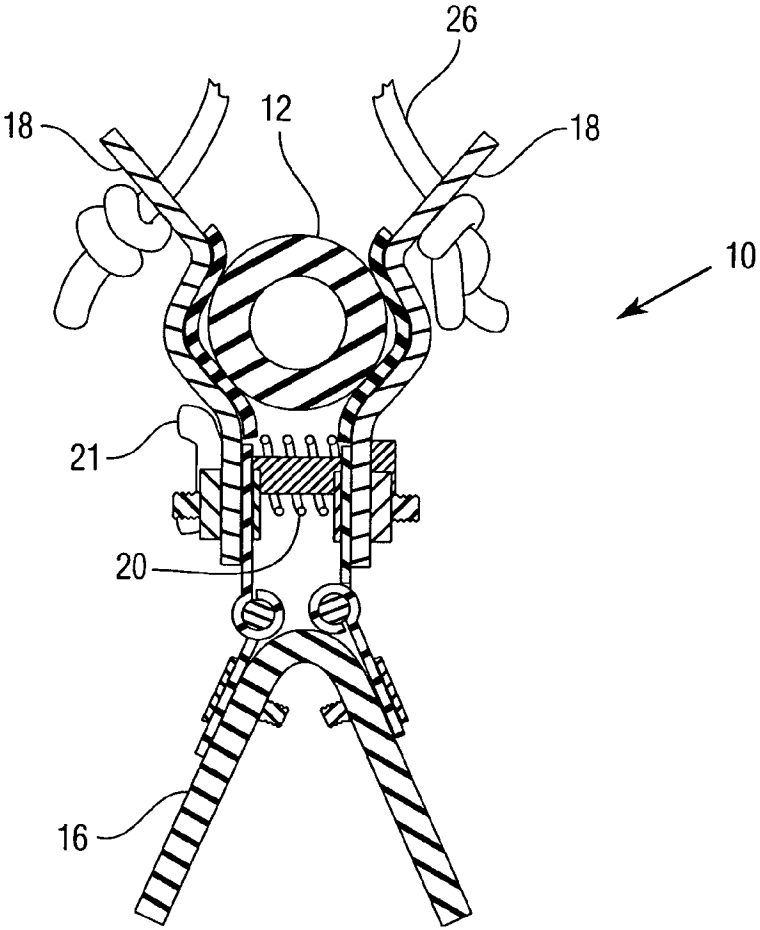
FIG. 13 is a cross section of plates holding large diameter barrel of the rifle.

A device 10 for attachment to a weapon such as a rifle or shotgun having a barrel 12 with a muzzle, a stock with a butt 14 and a trigger with a guard is formed with a body 16 (FIGS. 1-3). The body preferably has an inverted V-shape. Near one end of the body 16 formed on the apex of the V-shape are means to attach the barrel 12 of the weapon (FIG. 4). Preferably, the means are an adjustable clamp formed from a pair of plates 18, each being hingedly connected to the body 16 and having a spring 20 between the plates. The spring urges the tops of the plates away from one another. In this manner, the tops of the plates may be separated and the barrel 12 of the weapon may be held therebetween due to the urging of the spring 20. It is preferred that the inner surfaces of the plates 18 be lined with a rubber-like shock absorbing material to secure the barrel of the weapon without marring the surface of the barrel. A locking means 21 is provided to secure the barrel 12 between the plates 18.

A pair of extendable legs 24 are pivotably mounted on the body 16, one on each side thereof. The body is disposed proximal to the muzzle and the sights on the rifle. The legs 24 may be manually extended away from the body 16. The legs may be spring-mounted to automatically extend from the body 16 when a release is activated. When the device 10 is mounted on the barrel of the rifle, with the legs 24 spread, the butt of the rifle, together with the legs, form a tripod such that the muzzle, sight and scope are elevated above the ground and are kept clear of dirt and debris. The legs 24 may be formed of several telescoping sections which may be secured with a locking means 22.

A loop means 26 is formed on the body 16 of the device near the plates. The loop means may be flexible such as a lanyard. The loop 26 is securely attached to the body. A rope 28 or other flexible means is attached to the loop and used as will be explained.

As shown in FIGS. 6-11, the device 10 is used by a hunter climbing into an elevated stand such as a stand in a tree. Before climbing into the stand, the hunter places the barrel of his rifle in between the plates 26 which are adjustable to be able to receive a barrel having a large or a small diameter. The locking means 21 are engaged to secure the device 10 to the barrel of the rifle without further movement. The body 16 of the device is mounted, preferably, about six (6) inches from the end of the gun barrel. The legs 24 are extended outwardly from the body 16 and are locked in the extended position. The rifle is placed in a rest position on the ground with the two legs and the butt of the rifle forming a tripod. The trigger guard 32 is oriented away from the ground and the muzzle, bore, sights and scope are elevated above the ground. The rifle is inspected to ensure that it is unloaded and the bolt is back or the chamber is open. A safety strap 30 is inserted through the trigger guard 32 and connected to the body 16 of the device 10 so that there is no slack in the safety strap.

One end of a rope 28 or other flexible means is connected to the loop 26 on the body. The other end of the rope is held by the hunter as he climbs to the elevated stand. When the hunter has settled in the elevated stand, he pulls up on the rope 28, lifting the rifle from the ground by the loop 26 with the muzzle directed upwardly and the butt directed downwardly. The rifle is raised to the elevated stand. The safety strap is removed and the plates 18 are loosened so that the device 10 may be separated from the rifle.

When the hunter wishes to descend from the elevated stand, the above procedure is reversed. The device 10 is secured to the barrel of the rifle and the legs are extended. The rope is attached to the loop. The gun is inspected to be sure it is unloaded. The safety strap is attached. The rifle is lowered using the rope. The rifle is lowered butt first. The butt contacts the ground and the rifle is gently lowered until the legs touch the ground forming a tripod with the butt. The gun now is safely resting on the ground with the muzzle, bore, sights and scope elevated and the trigger directed upwardly. The hunter now descends from the elevated stand and disconnects the rifle from the device.

It is preferred that the device be made of aluminum or other sturdy lightweight material so that the weight is minimal for raising and lowering from the elevated stand. The present model made of aluminum weighs less than one pound.

Obviously, many modifications may be made without departing from the basic spirit of the present invention. Accordingly, it will be appreciated by those skilled in the art that within the scope of the appended claims, the invention may be practiced other than has been specifically described herein.

The invention claimed is:

1. A method of raising and lowering a weapon when climbing from a lower elevation to a higher elevation, the weapon having a barrel, a butt, a muzzle, a bore, a trigger, sights and/or scope, the method comprising the steps of providing a device and means for removably and securely attaching the device to the barrel of the weapon away from the butt of the weapon; the device including a pair of legs pivotably mounted thereon, one on each side thereof; manually extending the pivotable legs away from the device, wherein the legs are oriented oppositely from the trigger such that the legs and a butt portion of the weapon form a tripod for supporting the weapon in a substantially upright position with respect to the lower elevation, thereby keeping the muzzle, bore, sights and/or scope elevated above the butt and substantially free of dirt and/or debris; attaching a rope to the device near the muzzle of the weapon; climbing to the higher elevation; using the rope to pull up the device and the weapon from the ground; detaching the device from the weapon; and repeating the process substantially in reverse to lower the weapon to the lower elevation prior to climbing down from the higher elevation.

2. The method of claim 1, wherein the lower elevation is the ground.

3. The method of claim 1, wherein the higher elevation comprises a tree stand.

4. The method of claim 1, wherein the rope attachment means comprises a lanyard on the device.

5. The method of claim 1, wherein the weapon comprises a rifle.

6. A method of safely raising and lowering a rifle when climbing up and down from a tree stand during hunting season, the rifle having a barrel, a butt, a muzzle, a bore, a trigger, sights and/or scope, the method comprising the steps of providing a device and means for removably and securely attaching the device near an end of the barrel of the rifle distal from the butt, the device including a pair of legs pivotably mounted on the device, one on each side thereof; manually extending the pivotable legs away from the device and opposite from the trigger of the rifle, such that the legs of the device and the butt of the rifle form a tripod for supporting the rifle on the ground in a substantially upright position with the trigger directed upwardly, thereby keeping the muzzle, bore, sights and/or scope of the rifle substantially free of dirt and/or debris; attaching a rope to a lanyard on the device; climbing up to the tree stand; using the rope to pull up the device and the rifle from the ground; detaching the device from the rifle; and repeating the process substantially in reverse to lower the rifle to the ground prior to climbing down from the tree stand.

7. The method of claim 1, further comprising the legs on the device being spring mounted and a release being provided on the device to automatically extend the legs from the device.

* * * * *